United States Patent [19]

Böckenhoff et al.

[11] 4,066,477

[45] Jan. 3, 1978

[54] METHOD OF MAINTAINING TEMPERATURE OF SALT BATH DURING QUENCHING OF STEEL WIRE

[75] Inventors: Hermann-Josef Böckenhoff, Blecher; Walter Schaeffer, Cologne; Berthold Kranz, Duren, all of Germany

[73] Assignee: Arbed F & G Drahtwerke Cologne GmbH, Cologne, Germany

[21] Appl. No.: 598,666

[22] Filed: July 24, 1975

[30] Foreign Application Priority Data

July 25, 1974 Germany ..... 2435832

[51] Int. Cl.[2] ..... C21C 7/06; G05D 23/13

[52] U.S. Cl. ..... 148/15; 266/44; 266/112

[58] Field of Search ..... 148/15, 12 B, 12.4; 266/107, 112, 131

[56] References Cited

U.S. PATENT DOCUMENTS

| | | | |
|---|---|---|---|
| 1,936,719 | 11/1933 | Knerr | 266/131 |
| 2,023,736 | 12/1935 | Lloyd | 148/12.4 |
| 2,052,254 | 8/1936 | Shaver | 266/131 |
| 2,537,830 | 1/1951 | Holden | 148/15 |
| 2,556,349 | 6/1951 | Trautman | 266/131 |
| 2,931,745 | 4/1960 | Halgren | 148/28 |
| 3,645,802 | 2/1972 | Keough | 148/15 |
| 3,915,759 | 10/1975 | Smollett et al. | 148/15 |

OTHER PUBLICATIONS

"Water in Molten Salt Increases Quenching Power Lowers Operating Temperature", Case, et al., Metal Progress, Oct. 1953, pp. 122–124.

*Primary Examiner*—Arthur J. Steiner
*Attorney, Agent, or Firm*—Michael J. Striker

[57] ABSTRACT

A fluid is admitted into a bath having a certain temperature. The temperature of the fluid is different from that of the bath. The fluid travels through the bath so that heat transfer occurs between the bath and the fluid while, at the same time, the bath is thus caused to be agitated. The flow of the fluid into the bath is regulated in such a manner as to maintain the temperature of the bath within predetermined limits. A preferred application resides in the cooling of a bath, particularly one which is used for the heat treatment of steel wire which has been hot rolled immediately prior to the introduction thereof into the bath. Here, the fluid may be in the form of a gas upon being admitted into the bath. Alternatively, the fluid may be in the form of a liquid which vaporizes at the temperature of the bath. In this event, heat is removed from the bath partially in the form of the heat of vaporization of the liquid. It is also possible to feed both a gas and a liquid into the bath. In this manner, a cooling effect may be obtained which is less than that if only a vaporizable liquid were used without, however, incurring a loss in the degree of agitation of the bath.

5 Claims, 1 Drawing Figure

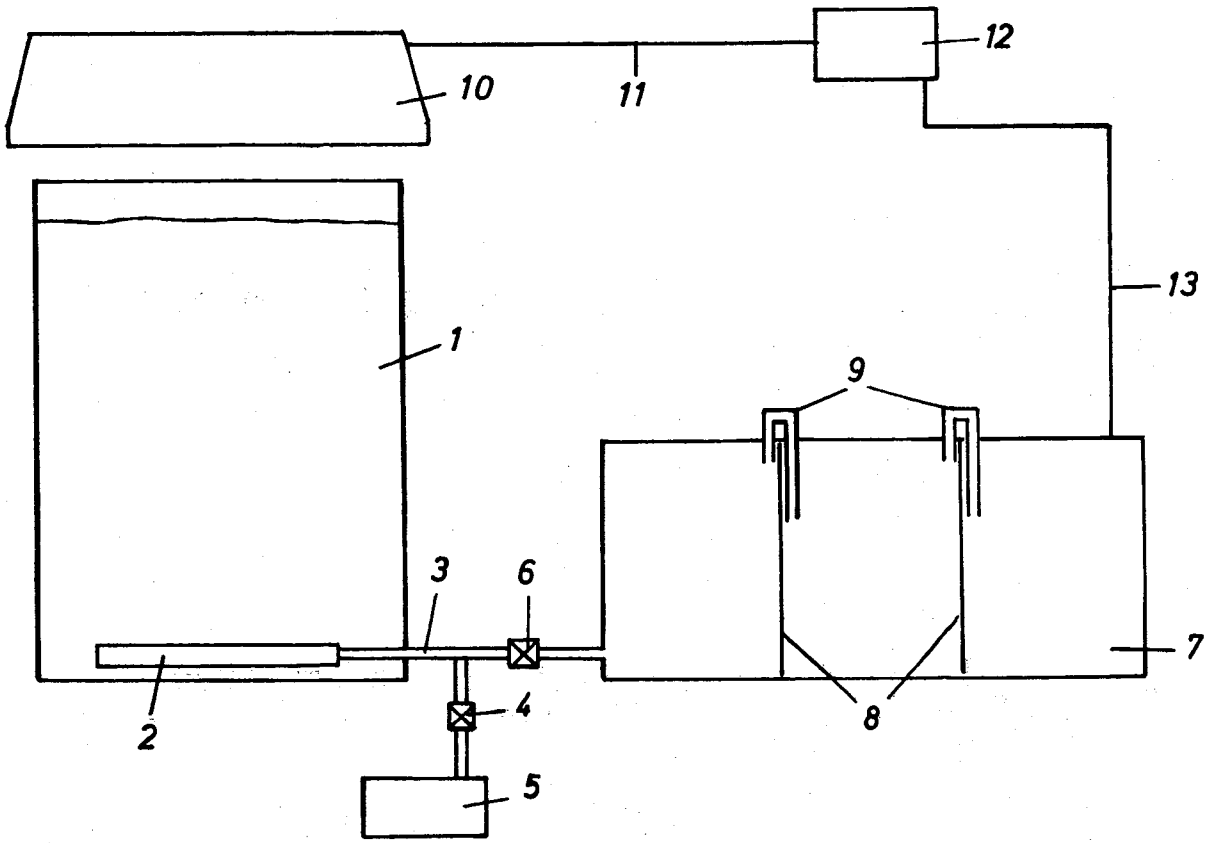
10
11
12
13
1
9
7
8
6
3
4
5
2

METHOD OF MAINTAINING TEMPERATURE OF SALT BATH DURING QUENCHING OF STEEL WIRE

BACKGROUND OF THE INVENTION

The invention relates generally to a method and arrangement for agitating baths and for controlling the temperature of the same. Of particular interest to the invention is the regulation of melts, such as molten salts, which are used for the heat treatment of metallic articles.

One purpose for which melts, such as molten salts, are utilized is to obtain a controlled colling of hot rolled steel wire so as to permit the latter to undergo a microstructural transformation.

It has already been proposed to introduce rolled wire into a salt melt having a temperature of 450° to 600° C after the wire has left the last stage of a rolling mill. If necessary, the wire may be subjected to a precooling operation subsequent to leaving the rolling mill and before the introduction thereof into the melt. The purpose of the melt is to rapidly cool the wire to the appropriate temperature range for the desired microstructural transformation and to maintain the wire at a constant temperature until the end of the transformation. Wire which has been treated in this manner possesses a tempered martensitic (sorbitic) structure which is well-suited for cold deformation of the wire by drawing.

Due to the existence of a large number of unsolved technological problems, the heat treating procedure outlined above has not heretofore been able to find application in large industrial production installations. One of these problems is associated with the large quantities of heat which are brought into the melt by the hot wire which is to be heat treated. Thus, it has not been possible to remove this heat from the melt in such a manner that, within the cycle of operation of the rolling mill, the temperature of the melt is maintained so constant within narrow limits that an optimum and reproducible microstructure is obtained. It is necessary, in order to obtain an optimum and reproducible microstructure, that the heating, and especially the cooling, of the melt be continuously and rapidly changed and, in particular, that the heating and the cooling of the melt be changed in dependence upon the operating cycle of the rolling mill.

A further problem results from the fact that it is necessary to cause such motion and mixing of the melt that accumulations of heat occur neither in the vicinity of the location where the wire is introduced into the melt nor in the regions of the coils which are formed from the wire prior to the introduction thereof into the melt. Thus, on the one hand, localized temperature increases may cause an undesired thermal decomposition of the reactive melt, and reactions with the container accommodating the melt, as well as with the material to be treated, may occur. On the other hand, localized temperature increases cause variable cooling conditions which, in turn, may adversely affect the quality of the wire by causing a nonhomogeneous microstructure to be obtained.

Conventionally, an external circulatory system is utilized for removing heat from the melt. Such a system generally includes fluid-conveying pumps and heat-exchangers. In practice, however, an external system of this type is incapable of removing the requisite quantities of heat from the melt, is incapable of generating the requisite agitation of the melt and, in particular, is incapable of rapid adjustment to the cooling and heating conditions required for the melt. Moreover, technical operating difficulties arise when using an external circulatory system due to the formation of incrustations and blockages. Aside from the high maintenance costs involved with arrangements of this type, they are exceedingly expensive to regulate and are of extremely costly construction.

Another unsolved problem relating to the heat treating procedure outlined above results from the fact that considerable quantities of the melt are dragged along with the wire when the latter is removed from the melt. Crusts are thus formed on the wire and these crusts usually consist of salt and salt mixtures. It is necessary, before further processing of the wire, to remove these crusts from the wire by means of a water rinse. However, the water used for the rinsing operation has a high concentration of salt and cannot, therefore, be simply discharged as waste water due to environmental considerations. Nor is it economically feasible to treat the rinsing water in order to recover the salt therefrom. It is for this reason also that a procedure for the heat treatment of wire by means of a salt melt directly after hot rolling has not been able to find application heretofore.

SUMMARY OF THE INVENTION

One object of the invention is to provide a method and arrangement which enable the temperature of a bath to be controlled with a high degree of precision.

Another object of the invention is to provide a method and arrangement which enable good agitation of a bath to be achieved.

A further object of the invention is to provide a method and arrangement which, in a simple and economical manner, enable the temperature of a bath to be controlled with a great degree of precision and which, concomitantly, enable good agitation of the bath to be achieved.

An additional object of the invention is to provide a method and arrangement for regulating the temperature and agitation of melts utilized for the heat treatment of metallic articles and which, by simple means, as well as with great rapidity and a high degree of certainty, enable the temperature of a melt to be maintained within narrow limits through the removal of heat from the melt and, simultaneously, enable an effective mixing of the melt to be realized. Moreover, the invention intends for the method and arrangement to be economical. The invention further intends for the method and arrangement to be compatible with the environment so that, particularly for applications involving the heat treatment of wire in molten salt, adverse influences on the environment by the fluid or water used for rinsing the wire may be substantially completely eliminated.

These objects, as well as others which will become apparent as the description proceeds, are achieved in accordance with the invention. According to one aspect of the invention, there is provided a method of agitating baths and controlling the temperature thereof wherein a fluid having a first temperature is admitted into a bath having a different second temperature. The fluid is conveyed through the bath to thereby effect heat transfer between the bath and the fluid while agitating the bath. The flow of fluid into the bath is regulated so as to maintain the temperature of the latter within predetermined limits.

As indicated previously, of particular interest to the invention are a method and arrangement for regulating the temperature and mixing of melts which serve for the heat treatment of metallic articles, and especially melts which are used for the controlled cooling of hot rolled steel wire in order to achieve a microstructural transformation. Accordingly, the description herein will be primarily with reference to such preferred application.

As briefly outlined above, an adjustable quantity of a fluid is admitted into the bath or melt in accordance with the invention. Advantageously, the fluid is admitted into the melt in the form of a gaseous medium and/or in the form of a liquid medium which vaporizes at the temperature of the melt. In other words, the fluid admitted into the melt is advantageously capable of existing in vapor phase at the temperature of the melt. Favorably, the fluid or medium is admitted into the melt in the lower region thereof so that the fluid or medium may travel upwardly through the melt.

As will be appreciated, the melt has an elevated temperature. Since the fluid will herein be assumed to serve as a coolant for the melt, it will be understood that the temperature of the fluid upon being admitted into the melt is no higher than the temperature of the melt. The cooling of a melt, that is, the removal of heat therefrom, may be desirable when the temperature of the melt is to be maintained approximately constant and articles having a temperature higher than that of the melt are introduced therein for treatment.

By means of the invention, a cooling of the melt is achieved due to the absorption of heat by the fluid admitted into the melt. Moreover, by admitting the fluid into a lower region of the melt, there may be achieved a good mixing or agitation of the melt due to the ascension of the fluid in the melt. As a result, localized temperature differences within the melt may be avoided.

According to one embodiment of the invention, water is injected directly into the melt. The water injected into the melt vaporizes and thus removes heat from the melt in the form of heat of vaporization. The removal from the melt of the heat required for vaporization enables an effective and readily controllable cooling effect to be obtained, the cooling effect corresponding to the quantity of water admitted into the melt. On the other hand, the water vapor generated, and which travels upwardly in the melt, simultaneously enables an agitation or mixing of the melt to be achieved.

According to another embodiment of the invention, a change in the cooling effect, without any substantial reduction in the degree of agitation of the melt, may be achieved in that the water vapor is partially or completely replaced by another gas. Examples of gases which may suitably be used for partially or completely replacing the water vapor are air and nitrogen. In other words, a change in the cooling effect without any substantial reduction in the degree of agitation may be achieved in that a quantity of gas is substituted for all or a portion of the water admitted into the melt.

It will be appreciated that, according to the invention, the fluid admitted into the melt may be entirely in the form of a liquid, may be entirely in the form of a gas or may include both a gas and a liquid.

According to yet another embodiment of the invention, the water vapor leaving the melt via the upper surface thereof is collected and condensed. In the event that the articles which have been treated in the melt are subsequently rinsed, the condensed water may be utilized in the rinsing stage and thereafter readmitted into the melt.

The latter embodiment of the invention enables particularly great advantages to be achieved as regards pollution of the environment. Thus, it has been mentioned earlier that considerable quantities of a melt may be dragged along when the articles which have been treated in the melt are removed therefrom. A particular case in point is that of wire which has been coiled and then introduced into a salt melt for heat treatment. Upon removal of the wire from the melt, substantial quantities of salt, which constitute a potential pollutant, are dragged out of the melt by the wire coils. By proceeding in accordance with the last-mentioned embodiment of the invention, it becomes possible for the salt which has been dragged out of the melt and into the rinsing water to be returned to the melt substantially in its entirety. Moreover, since the water vapor generated from the rinsing water which has been returned to the melt is collected and condensed, with the condensate then being recycled to the rinsing stage, a low level of water consumption may be achieved by virtue of the closed cycle. Also, it becomes possible to avoid the changes in the composition of the melt which would occur if fresh water were continuously admitted into the melt. If fresh water were continuously admitted into the melt, the minerals contained therein, and thus continuously brought into the melt, would be effective for changing the composition of the melt.

With respect to the nature of the melt, it is pointed out that water-soluble, alkali and alkaline earth salts are particularly well-suited for use as melts. Since the density and viscosity of these salts in the molten state are low, the passage of gas through the melt and the agitation of the melt may occur without any difficulties. Furthermore, the salt residues present on the metallic articles subsequent to the treatment thereof in the melt may be readily rinsed off with water.

A particularly preferred application of the invention relates to the heat treatment of steel wire in salt baths. Here, the wire is introduced into a bath of molten salt after leaving the rolling mill in order to obtain a microstructural transformation. If necessary or desirable, the wire may be precooled subsequent to leaving the rolling mill but prior to the introduction thereof into the salt melt. The wire may also be wound into the form of coils intermediate the hot rolling operation and the heat treatment in the melt. After the desired microstructural transformation has occurred, the wire, which may be in the form of coils, is removed from the melt, rinsed and sent on for its further processing.

The salt melt here has the conventional purpose of cooling the steel wire to a predetermined temperature as rapidly as possible, particularly where steel wire having a carbon content in excess of 0.3 percent by weight is concerned, and of holding the wire at this temperature until the desired microstructural transformation has ended. The desired microstructural transformation involves a transformation to a tempered martensitic (sorbitic) structure which is well-suited for cold deformation of the wire by drawing. The temperature to which the wire is cooled and at which it is held lies between about 450° and 600° C depending upon the carbon content of the wire and upon other alloying additions which may be present in the wire. The object of this treatment is to eliminate the additional lead bath patenting which would otherwise be required prior to drawing. The practicability of this treatment and the results thereof are, to a large degree, dependent upon the effectiveness of the cooling and the uniformity of the bath temperature.

The wire may be conveyed to the bath via suitable conveying means which may be of simple construction or may be constructed with a precooling section. As mentioned previously, the wire may be wound into the form of coils prior to the introduction thereof into the bath. This may be achieved by means of a coiling or winding device arranged above the salt bath which winds the wire into the form of individual, closely spaced and substantially horizontal coils. The wire may then be introduced into the salt melt in this form.

The container which accommodates the melt should be of such a depth that a distance of at least 1.5 meters is available for the free fall of the individual coils of the wire. This distance should be available also for the last coil to be wound from the wire. The individual coils of the wire sink through the melt, which latter is maintained at a substantially constant temperature and in an agitated condition, in freely suspended fashion and without mutual contact. During the course of their descent through the distance indicated above, the individual coils of the wire reach the transformation temperature. The rate of descent which is achieved in a particular instance is determined by the specific weight of the wire, the specific weight of the melt and the viscosity of the melt at the existing temperature.

At the beginning of the operation, the temperature of the melt, for example, a sodium nitrate melt, is raised to the range of about 450° to 600° C by means of a heating arrangement provided for the container which accommodates the melt. The heating arrangement may, for instance, be in the form of an induction heating device. The heat absorbed by the melt during operation from the steel wire which is cooled therein is continuously conveyed from the melt by the fluid injected into the interior of the melt.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE is a diagrammatic representation of one form of an arrangement in accordance with the invention which may be used for carrying out a method according to the invention.

DESCRIPTION OF THE PREFERRED EMBODIMENTS

Referring to the single FIGURE in detail, it is pointed out that the reference numeral 1 identifies a vessel which accommodates a melt. An annular distributor 2 having a plurality of nozzles is provided in the region of the bottom of the vessel 1. The distributor 2 is connected with a conduit 3 which, in turn, communicates with a gas container 5 via an adjustable valve 4.

The conduit 3 is further connected with a rinsing vessel 7 via another valve 6. In the illustrated embodiment, the rinsing vessel 7 is divided into a plurality of stages by means of dividing walls 8 and overflow conduits 9.

A hood 10 is located above the melt vessel 1. As will be self-understood, the hood 10 is either movably mounted or provided with openings for the purpose of introducing the articles to be heat treated into the melt. The latter possibility, that is, the provision of the hood 10 with openings, may be utilized when the material to be heat treated is in the form of steel wire, for instance. The hood 10 communicates with a condenser 12 via a conduit 11. The condenser 12 is, in turn, connected with the rinsing vessel 7 by means of a conduit 13.

In operation, the medium which is intended for the cooling and agitation of the melt is admitted into the lower region of the melt through the distributor 2. In the illustrated embodiment, the medium which is used for cooling and agitating the melt comprises water which is withdrawn from the rinsing vessel 7 in which the articles which have been heat treated are rinsed. The quantity of water admitted into the melt may be regulated by means of the valve 6. For this purpose, a measuring and regulating circuit which is known per se, and which has not been illustrated here for the sake of clarity, may be provided. This circuit may regulate the flow of water into the melt via an actuating motor which is coupled with the valve 6 and which has also not been shown here for the sake of clarity. The flow of water into the melt may be controlled as a function of the departure from a predetermined temperature value which is measured by a sensing device extending into the melt. Again, the sensing device has not been illustrated in the FIGURE for the sake of clarity.

The water admitted into the melt is vaporized, that is, transforms into water vapor. The water vapor travels upwardly through the melt and escapes therefrom via the upper surface thereof. The water vapor leaving the melt through the upper surface thereof is collected by the hood 10 and is thereafter conveyed to the condenser 12 via the conduit 11. The condensate generated in the condenser 12 travels to the rinsing vessel 7 through the conduit 13. In the rinsing vessel 7, the condensate is used for rinsing the articles which have been heat treated in the melt. Subsequently, the condensate is returned to the melt vessel 1 in a closed cycle via the valve 6 and the conduit 3.

As just indicated, the articles which have been heat treated in the melt are subjected to a rinsing operation in the rinsing vessel 7. In this manner, the articles may be freed from residues of the melt adhering thereto. For the purpose of rinsing the articles, the latter may be conveyed through the rinsing vessel 7 in a direction which is countercurrent to the direction of flow through the rinsing vessel 7 of the condensate used for the rinsing operation. The melt residues removed from the articles in the rinsing vessel 7 are returned to the melt via the conduit 3.

By virtue of the vaporization of the water injected into the melt, and by virtue of the ascension of the water vapor in the melt, there is obtained an effective cooling of the melt, particularly as a result of the fact that the heat of vaporization required for the water is derived, and thus removed, from the melt. On the other hand, an intensive agitation of the melt, and a concomitant equalization of the temperature within the melt, are achieved.

In order to permit a sufficient agitation of the melt to be maintained when the flow of water into the melt is reduced or discontinued completely, a portion of the water, or the entire quantity of water, may at any time be replaced by a flow of gas from the gas container 5. The regulation of the gas flow is here effected by adjustment of the valve 4. Since the quantity of heat removed from the melt by the gas is considerably less than that removed by the water, it thus becomes possible to obtain a curtailed cooling effect and yet achieve an adequate agitation of the melt.

Due to the controllable cooling possibilities which are achievable for a melt in accordance with the invention, it becomes possible to remove heat from the articles, e.g. wires, to be heat treated in a most uniform manner. Moreover, the advantage associated with the substantially higher heat transfer values obtainable by treatment in a melt, as opposed to the heat transfer values obtainable by treatment in air, may be utilized.

The invention further enables the advantage to be achieved that the arrangement which is required for agitating and controlling the temperature of the melt may be technically simple to regulate and may be of an inexpensive construction. The arrangement may be directly used in combination with the newer wire rolling mills which operate at high speed and makes it possible to produce rolled wire which is equivalent in quality to wire which has been treated in a lead bath.

Furthermore, by using water as a medium for the cooling and agitation of the melt, there arises the possibility of conveying the medium which is utilized for cooling and agitation in a closed cycle and of using this medium for the rinsing of the articles which have been treated in the melt. The melt residues removed from the articles by rinsing may then be returned to the melt in a positive manner. As a result, the problem of disposing of the rinsing fluid or water, as well as the problem of recovering the melt residues which are obtained during rinsing, may be completely eliminated.

It may be mentioned that, in general, the fluid which is used according to the invention should be of such a nature that it does not undergo adverse reactions with the melt, at least to any significant extent.

Although an important application contemplated for the invention is in the heat treatment of steel wire which is obtained in a hot condition after a hot rolling operation, the invention may, however, also be applied to melts, and particularly salt melts, which are used for other purposes and, in general, to all types of baths. For example, the invention may find application in baths which are used for the continuous or discontinuous heat treatment of metallic articles and may also find application in the thermostatic control of reaction vessels.

It will be understood that each of the elements described above, or two or more together, may also find a useful application in other types of methods and installations differing from the types described above.

While the invention has been illustrated and described as embodied in a method and arrangement for agitating and controlling the temperature of melts used for the heat treatment of metallic articles, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method for the continuous microstructure-developing treatment of steel wire in molten salt baths, comprising rapidly cooling hot steel wire by continuously introducing said hot steel into a relatively cool molten salt bath having a working temperature which is within a range of 450°–600° C; and maintaining the temperature of said relatively cool salt bath within the range of 450°–600° C despite the quantities of heat which are brought into said molten salt bath during the step of introducing and which would substantially increase the working temperature to a temperature beyond the range of 450°–600° C., said step of maintaining comprising mixing liquid water with a gas selected from the group consisting of air and nitrogen, and subsequently injecting the mixture of water and gas into said molten salt bath.

2. A method as defined in claim 1, wherein said water vaporizes at the temperature of said bath and effects a first cooling action following from simple heat exchange and a second cooling action following vaporization of said water whereby additional heat corresponding to the heat of vaporization of said water is removed from said molten salt bath.

3. A method as defined in claim 2, further comprising forming a condensate by continually collecting and condensing said vaporized water, rinsing said steel wire with said condensate in order to separate adherent salt from said steel wire after its removal from said molten salt bath, collecting said rinsing condensate including the salts and adding them to said molten salt bath.

4. A method as defined in claim 1, wherein said water has a temperature lower than that of the working temperature of said molten salt bath.

5. A method as defined in claim 1, further comprising varying the cooling effect of the liquid water while maintaining a constant agitation of said molten salt bath by varying the proportions of gas to liquid water during said mixing step.

* * * * *